US008858362B1

(12) United States Patent
Leposky et al.

(10) Patent No.: US 8,858,362 B1
(45) **Date of Patent: *Oct. 14, 2014**

(54) GOLF CLUB HEAD WITH WEIGHT PORTS

(71) Applicant: Callaway Golf Company, Carlsbad, CA (US)

(72) Inventors: Mark Leposky, Carlsbad, CA (US); Bradley C. Rice, Carlsbad, CA (US); William C. Watson, Temecula, CA (US); Patrick Dawson, San Diego, CA (US); Irina Ivanova, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 93 days.

This patent is subject to a terminal disclaimer.

(21) Appl. No.: 13/788,044

(22) Filed: Mar. 7, 2013

Related U.S. Application Data

(63) Continuation-in-part of application No. 13/629,391, filed on Sep. 27, 2012, now Pat. No. 8,753,226, which is a continuation-in-part of application No. 13/451,887, filed on Apr. 20, 2012, now Pat. No. 8,540,588, which is a continuation-in-part of application No. 13/363,551, filed on Feb. 1, 2012, now Pat. No. 8,197,357, which is a continuation-in-part of application No. 13/248,855, filed on Sep. 29, 2011, now Pat. No. 8,444,506, which is a continuation-in-part of application No. 12/940,371, filed on Nov. 5, 2010, now Pat. No. 8,414,422.

(60) Provisional application No. 61/388,124, filed on Sep. 30, 2010, provisional application No. 61/286,971, filed on Dec. 16, 2009.

(51) Int. Cl.
*A63B 53/04* (2006.01)
*A63B 53/06* (2006.01)

(52) U.S. Cl.
CPC ..... *A63B 53/06* (2013.01)
USPC ..... 473/334; 473/335; 473/338; 473/345; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 6,773,360 | B2 * | 8/2004 | Willett et al. | 473/334 |
| 7,166,040 | B2 * | 1/2007 | Hoffman et al. | 473/334 |
| 7,731,603 | B2 * | 6/2010 | Beach et al. | 473/335 |
| 8,197,357 | B1 * | 6/2012 | Rice et al. | 473/334 |
| 8,197,358 | B1 * | 6/2012 | Watson et al. | 473/334 |
| 8,235,843 | B1 * | 8/2012 | Rice et al. | 473/334 |
| 8,262,506 | B2 * | 9/2012 | Watson et al. | 473/334 |
| 8,414,422 | B2 * | 4/2013 | Peralta et al. | 473/334 |
| 8,444,506 | B2 * | 5/2013 | Watson et al. | 473/334 |
| 8,485,919 | B2 * | 7/2013 | Rice et al. | 473/334 |
| 8,540,588 | B2 * | 9/2013 | Rice et al. | 473/334 |
| 8,753,226 | B2 * | 6/2014 | Rice et al. | 473/334 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club head having a face component, a crown, and a sole or a body patch with one or more weight ports for receiving one or more weight inserts is disclosed herein. At least part of each of the weight ports is integrally formed in the sole or body patch, and each of the weight ports includes an upper edge, a lower edge, and a wall having a variable thickness and varying radius.

16 Claims, 15 Drawing Sheets

GOLF CLUB HEAD WITH WEIGHT PORTS

CROSS REFERENCES TO RELATED APPLICATIONS

The present application is a continuation-in-part of U.S. patent application Ser. No. 13/629,391, filed on Sep. 27, 2012, which is a continuation-in-part of U.S. patent application Ser. No. 13/451,887, filed on Apr. 20, 2012, which is a continuation-in-part of U.S. patent application Ser. No. 13/363,551, filed on Feb. 1, 2012, now U.S. Pat. No. 8,197,357, which is a continuation-in-part of U.S. patent application Ser. No. 13/248,855, filed on Sep. 29, 2011, which claims priority to U.S. Provisional Application No. 61/388,124, filed on Sep. 30, 2010, and is a continuation-in-part of U.S. patent application Ser. No. 12/940,371, filed on Nov. 5, 2010, which claims priority to U.S. Provisional Application No. 61/286,971, filed on Dec. 16, 2009, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a sole or composite body patch with one or more formed weight ports to house one or more removable weights. More specifically, the present invention relates to a golf club head having a sole or composite body patch with integrally formed weight ports and a removable, metal weight insert.

2. Description of the Related Art

As driver golf club heads have increased in volume to greater than 300 cubic centimeters, their moments of inertia have also increased, providing greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the front face of the golf club head.

As the center of gravity is positioned further rearward from the front face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness of ball flight. For off-center hits above the sweet spot, the increased gear effect causes reduced backspin, which can cause an undesirable trajectory having insufficient carry length or time of flight, which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head mass. Such mass distributions are dependent on minimum wall thickness values required to achieve acceptable in-service durability.

The practical limitation is that as the face size is increased, hit locations in certain regions around the face perimeter will yield an unsatisfactory ball flight due to the above-mentioned deleterious effects, which are accentuated for larger faces. The deleterious effects increase in a non-linear manner as the distance from the face center increases. Thus the incremental face area gained by increasing face size will be subject to more extreme deleterious effects. This limits the practical length of the club, because probable hit distribution across the surface of the face broadens as the club length increases. As a result, a longer club will yield a larger percentage of hits in the perimeter regions of the face where the deleterious effects occur. This offsets the otherwise beneficial effect of increased head speed. As club length increases, head speed increases up to a length of approximately 52 inches, at which point aerodynamic and biomechanical effects offset the length effect.

Further, conventional head designs having a center of gravity positioned substantially rearward from the face are subject to significant dynamic loft effects, which can be undesirable. Dynamic loft increases with head speed, so that golfers with higher head speeds experience more dynamic loft than those with slower swing speeds. This is opposite of what is desired as higher head speeds generally require less loft, otherwise excess backspin will be generated, which negatively affects trajectory and performance.

Currently, golf club heads made of metal, composite, or other material are produced with a specific weight which is fixed once the golf club head is finished. The fixed weight of the golf club head determines the center of gravity and moment of inertia. After the golf club head is finished, there exists a small amount of weight which needs to be adjusted. This small amount of weight is called the swing weight. Presently, if the swing weight needs to be adjusted, to alter the center of gravity and/or moment of inertia, the fixed weight must be changed, which requires the manufacture of a new golf club head.

One invention that addresses a golf club head with an improved moment of inertia and center of gravity is U.S. Pat. No. 7,559,851 issued to Cackett et al. for Golf Club Head with High Moment of Inertia. This patent discloses a golf club head with a moment of inertia, Izz, about the center of gravity of the golf club head that exceeds 5000 grams-centimeters squared.

Another example is U.S. Pat. No. 3,897,066 to Belmont which discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

Yet another example is U.S. Pat. No. 2,750,194 to Clark which discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

Although the prior art has disclosed many variations of golf club heads with weight adjustment means, the prior art has failed to provide a club head with both a superior material construction and a high-performance weighting configuration.

BRIEF SUMMARY OF THE INVENTION

It is the object of this invention to adjust the swing weight of the golf club head externally, without having to manufacture or purchase a new golf club head. A golfer using the present invention will be able to adjust the center of gravity and moment of inertia to best suit his or her playing needs. The golf club head has external weights positioned at specific locations on the golf club head body to improve the center of gravity and moment of inertia characteristics. The weights to be inserted into the cavities of the golf club head all may be of the same size and shape, however will vary in density. This allows for the weights to be interchangeable depending on the golfer's individual needs. The aft-body of the golf club head is preferably composed of a metal material with recessed cavities to engage the weights, though in alternative embodiments the aft-body may be composed of a composite material. Alternatively, the aft-body comprises a cutout covered by a body patch composed of composite material having one or more recessed cavities to engage the weights.

One aspect of the present invention is a golf club head comprising a metal face component comprising a striking surface and a face extension, and a metal aft body comprising a crown, a sole, and at least one weight port, wherein the at least one weight port comprises an upper edge, a lower edge, and a wall extending around the entire circumference of the weight port, and wherein the at least one weight port is integrally formed with the sole. In some embodiments, the wall may not comprise any ribs, and instead the wall may comprise a thickness that changes gradually from the upper edge to the lower edge and is thickest at a point located between the upper edge and the lower edge, and the wall may comprise multiple radii. In some further embodiments, the wall may comprise a concave surface. In other further embodiments, the wall may comprise a generally conical shape, and a thickest point of the wall may be located approximately midway between the upper edge and the lower edge. The golf club may further comprise at least one removable weight sized to fit within and make direct contact with the at least one weight port.

In some embodiments, the sole may comprise a heel section and a toe section, and the at least one weight port may be disposed in the toe section. In a further embodiment, the sole may comprise a second weight port, which may be located in the heel section. The weight port may further comprise a weight receiving region having a first diameter and a first bore having a second diameter, and the first diameter may be greater than the second diameter. In a further embodiment, the first bore may comprise threads. In another embodiment, the golf club head may further comprise a screw-receiving component comprising a second bore, and the screw-receiving component may be affixed to the weight port such that the first bore aligns with the second bore. In some embodiments, the screw-receiving component may be composed of a metal material.

Yet another aspect of the present invention is a driver-type golf club head comprising a metal face component comprising a striking surface and a face extension, a crown, a sole, and at least one removable weight, wherein the sole comprises at least one weight port comprising an upper edge, a lower edge, a wall extending around the entire circumference of the weight port, a weight receiving region having a first diameter, and a first bore having a second diameter, wherein the first diameter is greater than the second diameter, wherein the first bore comprises threads, wherein the at least one removable weight is sized to fit within and make direct contact with the at least one weight port, wherein the at least one weight port is integrally formed with the sole, and wherein the golf club head has a volume of at least 400 and no more than 500 cubic centimeters. In a further embodiment, the wall may not comprise any ribs, and the wall may comprise multiple radii, a concave surface, and a thickness that changes gradually from the upper edge to the lower edge and is thickest at a point located approximately midway between the upper edge and the lower edge. In some embodiments, the sole may comprise at least two embodiments. In other embodiments, at least one weight port may be located in each of the crown and the sole. In still other embodiments, the crown may be composed of a composite material.

Another embodiment of the present invention is a wood-type golf club head comprising a face component comprising a striking surface and a return portion, the face component composed of a metal alloy, a metal sole comprising at least one weight port, the at least one weight port integrally formed with the sole and at least one removable weight screw comprising a head portion and a threaded extension portion, wherein the at least one weight port comprises an upper edge, a lower edge, a wall, a weight receiving region having a first diameter, and a bore having a second diameter, wherein the first diameter is greater than the second diameter, wherein the head portion is sized to fit within the weight receiving region, and wherein the bore comprises threads sized to mate with the threaded extension portion. In some embodiments, the wall may not comprise any ribs, and the wall may have multiple radii and a thickness that changes gradually from the upper edge to the lower edge and is thickest at a point located approximately midway between the upper edge and the lower edge. In some embodiments, the golf club head may have a volume of no less than 120 cubic centimeters and no more than 500 cubic centimeters. In other embodiments, the wall may comprise a concave surface.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
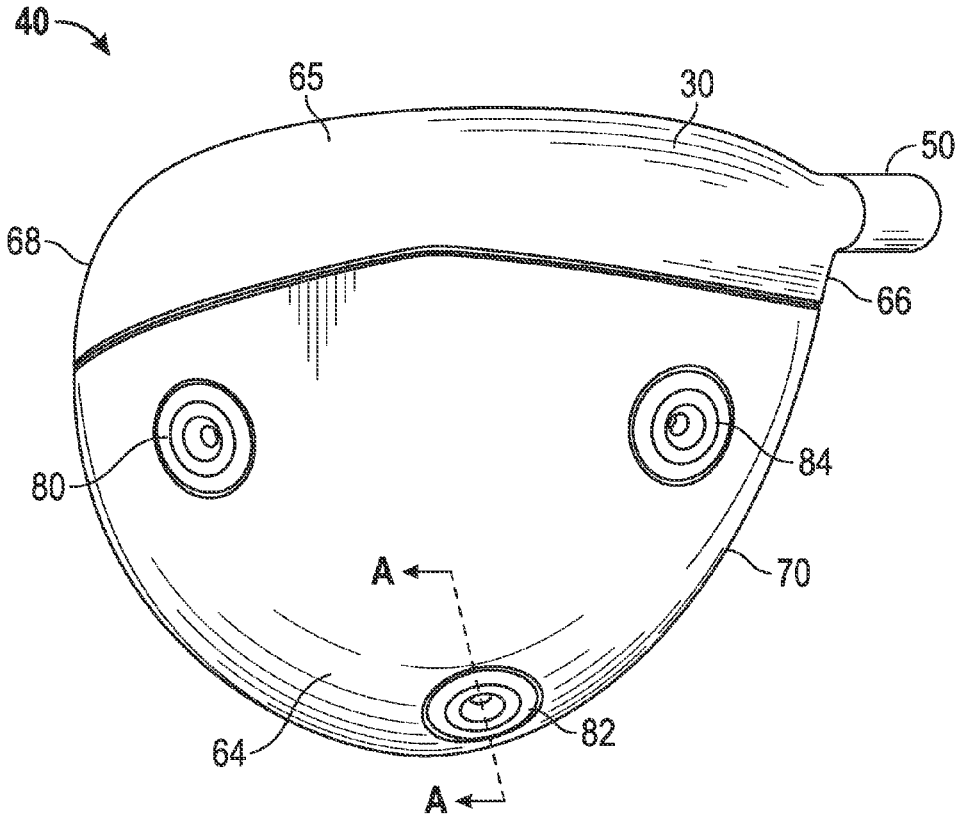
FIG. 1 is sole-side view of a golf club head according to an embodiment of the present invention.
Figure 2:
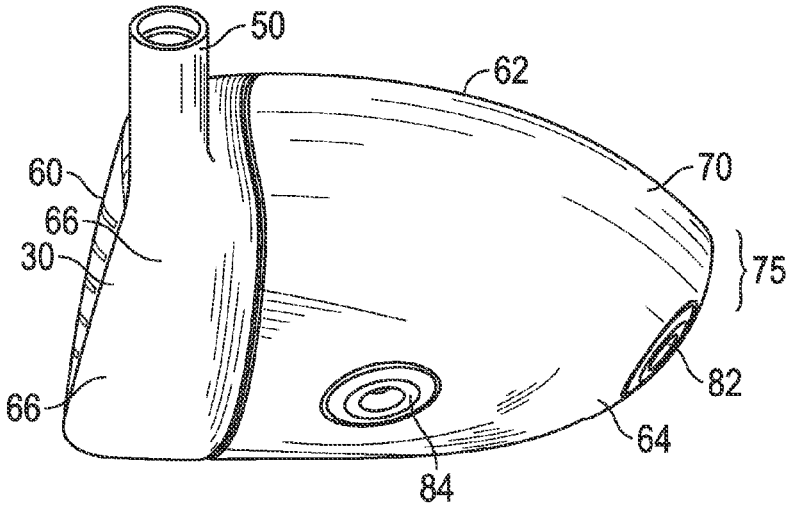
FIG. 2 is a heel-side view of the golf club head shown in FIG. 1.
Figure 3:
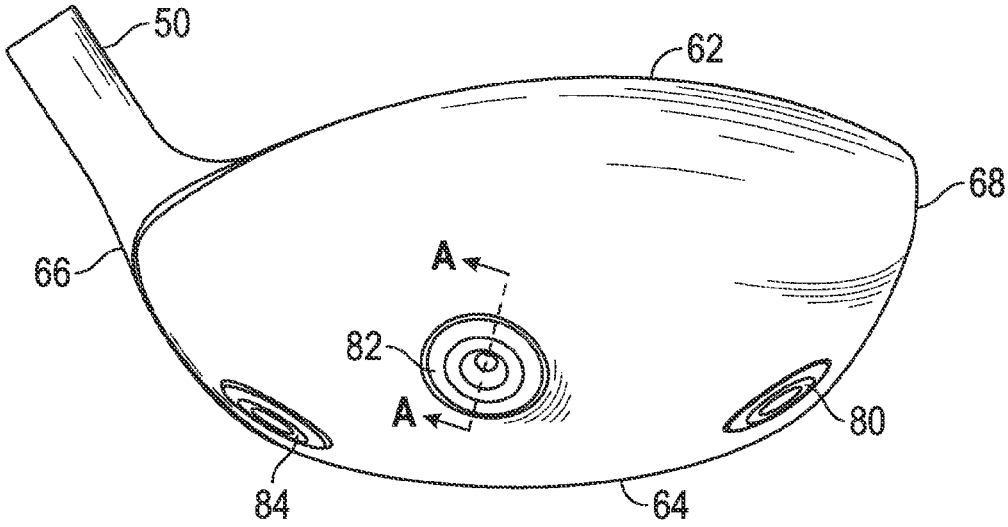
FIG. 3 is a rear view of the golf club head shown in FIG. 1.

The present invention is generally directed to a golf club head with one or more weight ports that are formed in a sole or a composite sole patch and house removable weight inserts. In the preferred embodiments, the one or more weight ports are integrally formed in the sole or body patch.

Views of the preferred embodiment of the present invention are shown in FIGS. 1-5. The golf club head 40 shown in FIGS. 1-3 has a hollow interior 90, shown in FIG. 5, and is generally composed of a face component 30 (also known as a face cup) comprising a striking face 60, a face extension 65 (also known as a return portion), and a hosel 50 (though the hosel may, in an alternative embodiment, be a separate piece), and an aft body 70 comprising a crown 62 and a sole 64 having three weight ports 80, 82, 84. In alternative embodiments, the golf club head 40 may have one, two, or more than three weight ports. The club head 40 also may optionally have a ribbon, skirt, or side portion (not shown) disposed between the crown 62 and sole 64 portions. The golf club head 40 is preferably partitioned into a heel section 66 nearest the hosel 50, a toe section 68 opposite the heel section 66, and a rear section 75 opposite the face 60. The preferred embodiment of the golf club head 40 shown in FIGS. 1-5 has a volume of approximately 460 cubic centimeters and a face 60 with a characteristic time that is close to, but does not exceed, 257 μs.

Figure 4:
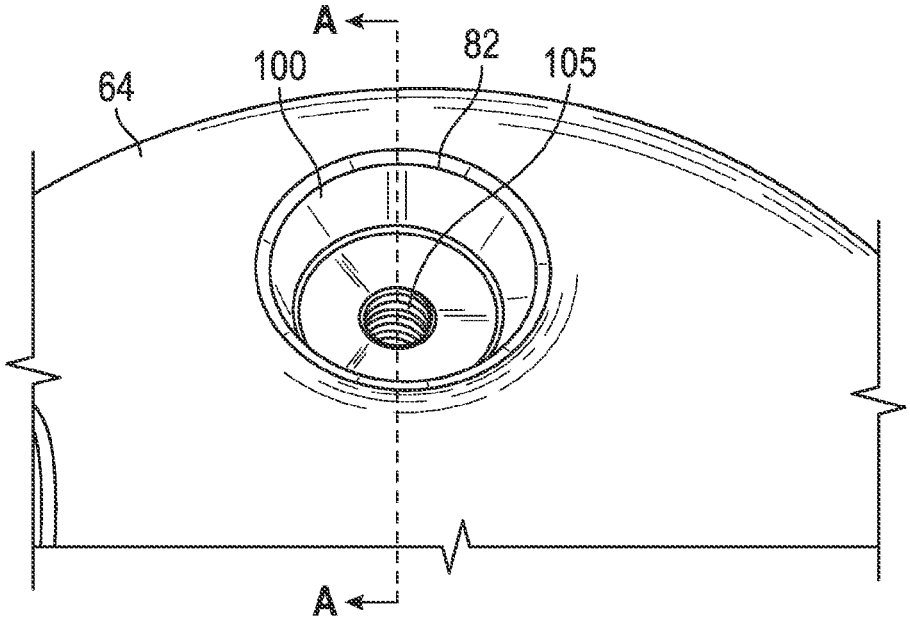
FIG. 4 is a top view of a weight port shown in FIG. 1.
Figure 5:
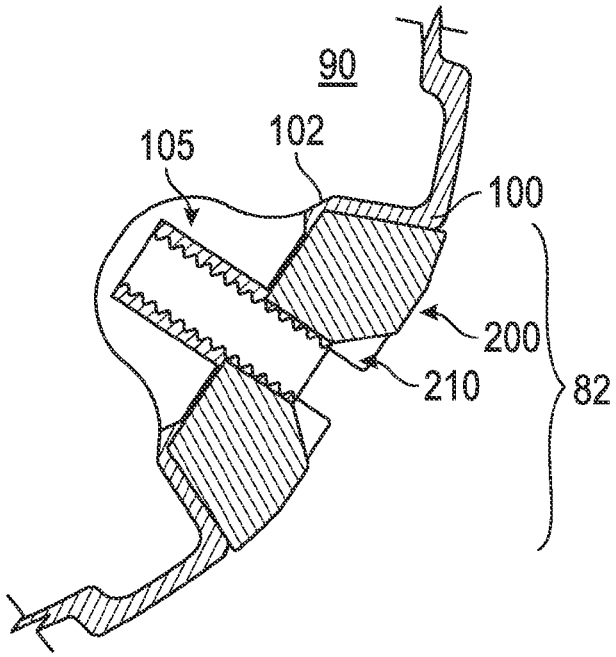
FIG. 5 is a cross-sectional view of the weight port and golf club head shown in FIG. 4 along line A-A.

In the preferred embodiment shown in FIGS. 1-5, the face component 30 is made of titanium and the aft body 70 (including the crown 62 and sole 64) is made of a metal material, preferably also titanium. At least part of each weight port 80, 82, 84 is integrally formed in the sole 64. As shown in FIGS. 4 and 5, the weight port 82 comprises a weight receiving region 100 and a screw-receiving region 105. In one embodiment, the weight receiving region 100 is the portion of the weight port 82 that is integrally formed in the sole and the screw-receiving region 105 is a separate metal piece, e.g., a screw-receiving boss with internal threads, which is affixed to the interior surface 102 of the weight receiving region 100. The screw-receiving region 105 preferably is affixed to the interior surface 102 of the weight receiving region 100 with an adhesive or another means.

Figure 7:
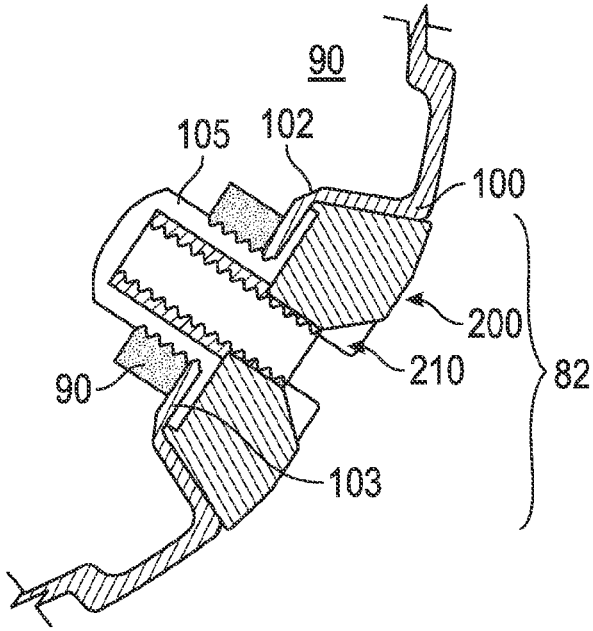
FIG. 7 is a cross-sectional view of an alternative configuration of the weight port and golf club head shown in FIG. 4 along line A-A.

The screw-receiving region 105 may also, in an embodiment shown in FIG. 7, be affixed to the exterior surface 103 of the weight receiving region 100 with an adhesive or with a mechanical fastener such as a nut 90, which is affixed to a lower portion of the screw-receiving region 105 to effectively sandwich the weight-receiving region 100 between the screw-receiving region 105 and the nut 90. In this embodiment, the screw-receiving region 105 rests against the exterior surface 103 of the weight receiving region 100 and extends into the golf club head. If the screw-receiving region 105 is mechanically affixed to the weight receiving region 100 in this manner, it is preferable for an exterior surface of the screw-receiving region 105 to have threads so that the nut 90 can securely engage with the screw-receiving region 105. Other techniques of affixing the screw-receiving region 105 to the weight receiving region 100 may be utilized. In alternative embodiments, such as those shown in FIGS. 27 and 28 the screw-receiving region 105 may be composed of a material other than metal, such as composite or plastic. In still further embodiments, the screw-receiving region 105 is integrally formed (e.g., cast, formed, forged) with the weight receiving region 100.

As shown in FIG. 5, a weight 200 is placed into the weight port 82 and received by the weight receiving region 100. The weight 200 is secured within the weight port 82 with a screw 210. The weight 200 may be removed from the weight port 82 by unscrewing the screw 210 and removing both the screw 210 and the weight 200 from the weight port 82.

Figure 6:
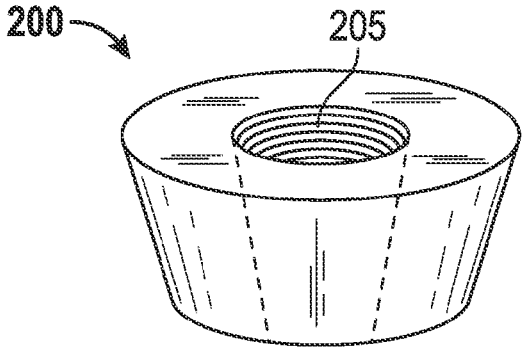
FIG. 6 is a side perspective view of a weight insert that can be used with the golf club head shown in FIG. 1.
Figure 8:
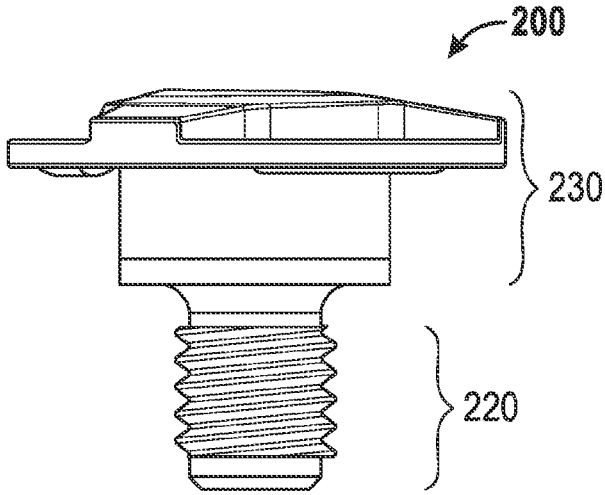
FIG. 8 is a side plan view of an alternative weight that can be used with the golf club head of the present invention.

In the preferred embodiment, the weight ports 80, 82, 84 are shaped to receive a conical weight. Also in the preferred embodiment, the weight 200 is conical in shape with a central aperture 205 for receiving a screw 210, as shown in FIG. 6, and both the weight 200 and the screw 210 are composed of a metal material. The weight 200 and screw 210 may, in alternative embodiments, be composed of other materials, such as composite or plastic. In some embodiments, the weight 200 and/or screw 210 may be made of stainless steel, titanium, tungsten, or other metal materials. In an alternative embodiment, the weight 200 may be a different shape, such as asymmetric or cylindrical instead of conical, and may comprise an integrally formed screw portion 220 as shown in FIG. 8, which makes a separate screw 210 unnecessary. In the embodiment shown in FIG. 8, the weight 200 is a weight screw having an integrally formed screw portion 220 and a cylindrical head portion 230.

The weight 200 preferably ranges in mass between 1 grams and 40 grams, more preferably between 10 grams and 30 grams, and most preferably 15 grams to 25 grams. More specifically, if the weight 200 is chosen for insertion in the toe-section 68 weight port 80, the weight 200 preferably ranges in mass between 5 grams and 25 grams, more preferably between 6 grams and 20 grams, and most preferably 6 grams to 16 grams. More specifically, if the weight 200 is chosen for insertion in the heel section 66 weight port 84, the weight 200 preferably ranges in mass between 10 grams and 40 grams, more preferably between 10 grams and 30 grams, and most preferably 12 grams to 29 grams. More specifically, if the weight 200 is chosen for insertion in the rear section 75 weight port 82, the weight 200 preferably ranges in mass between 10 grams and 40 grams, more preferably between 15 grams and 30 grams, and most preferably 23 grams.

Other embodiments of the present invention are shown in FIGS. 9-12. In these embodiments, only a portion of the aft body 70, specifically a body patch 300, is formed of a composite material. The remainder of the aft body 70, which includes a cutout portion 77 in the sole 64 near the toe section 68 of the club head 40, can be composed of any material, but is most preferably composed of a metal alloy, and most preferably a titanium alloy such as 6-4 titanium. The aft body 70 includes a ledge 72 against which the composite body patch 300 rests and to which the composite body patch 300 is bonded. In alternative embodiments, discussed in greater detail herein, the composite body patch 300 may comprise a ledge 305 instead of or in addition to the aft body 70 ledge 72. In alternative embodiments, the cutout portion 77 may be located in an area of the aft body 70 other than the toe section 68. The composite body patch 300 may be formed using one or more of the techniques described in U.S. Patent Publication Nos. 20100139079 and 20110065528, and U.S. patent application Ser. No. 12/886,773, and includes an integrally formed weight port 350 similar or identical to the one described with reference to the embodiments shown in FIGS. 1-5 and FIGS. 23-28.

Figure 9:
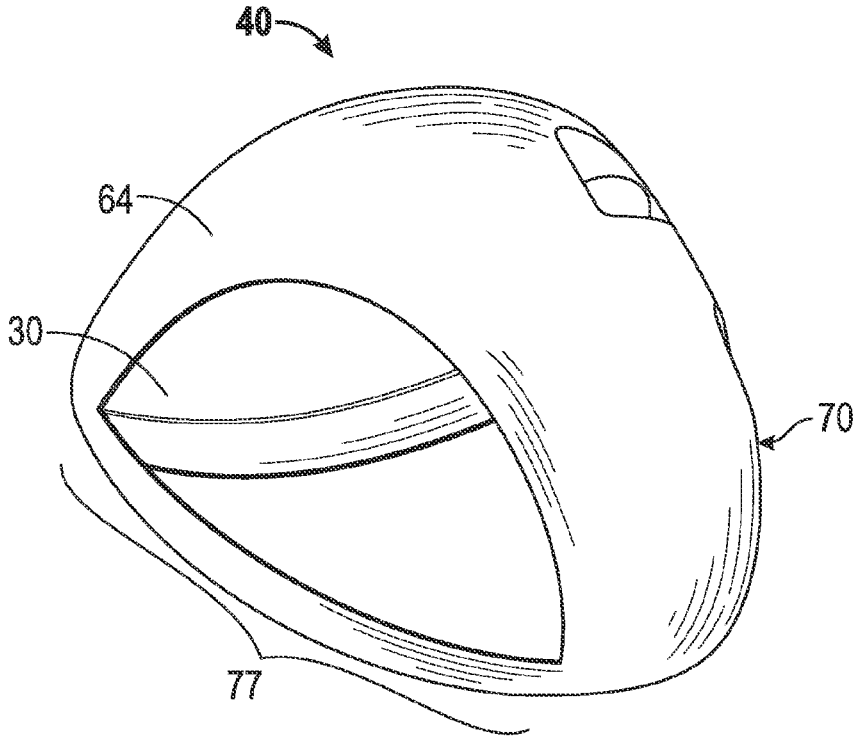
FIG. 9 is a bottom, rear perspective view of a second embodiment of the present invention with an exposed cutout portion.
Figure 10:
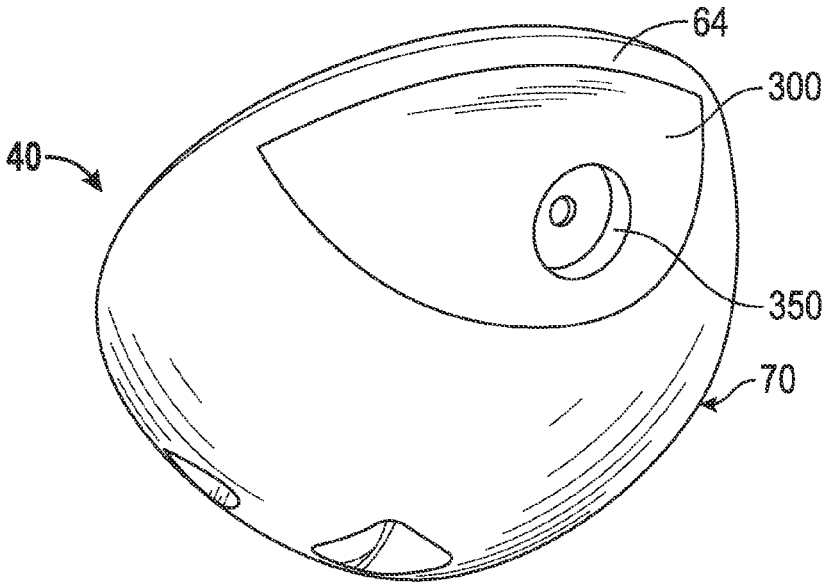
FIG. 10 is a bottom, toe-side perspective view of the embodiment shown in FIG. 9 with the cutout portion covered by a composite body patch.
Figure 11:
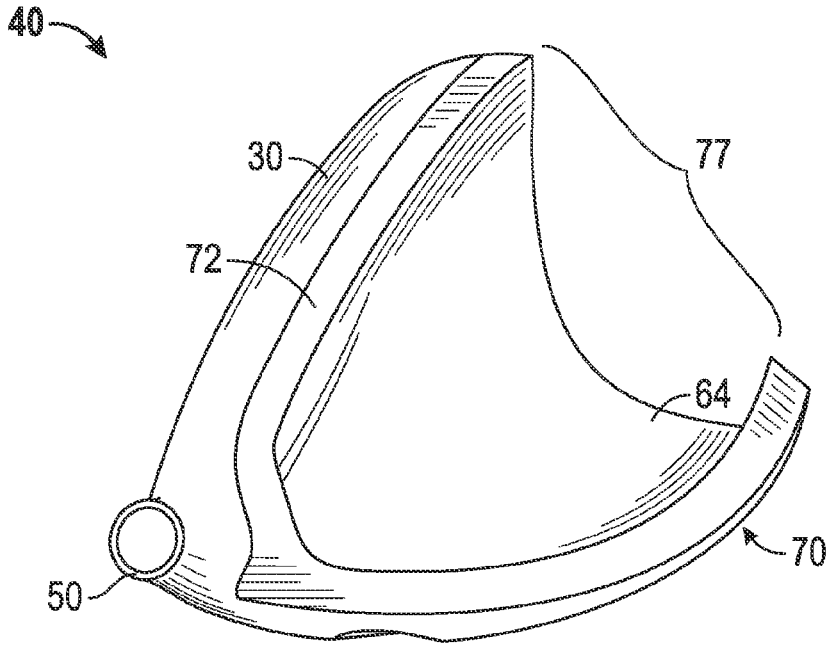
FIG. 11 is top perspective view of a third embodiment of the present invention with an exposed cutout portion.
Figure 12:
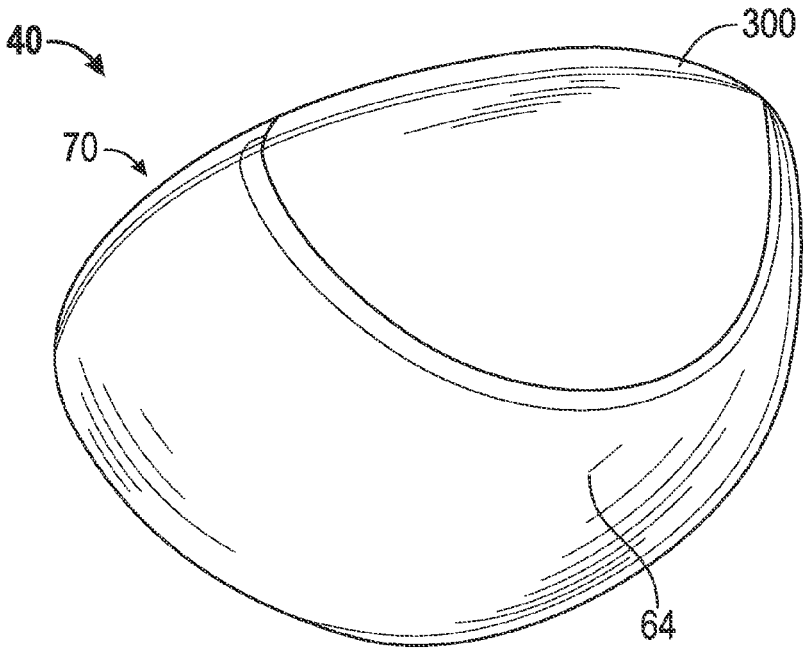
FIG. 12 is a bottom, toe-side perspective view of the embodiment shown in FIG. 11 with the cutout portion covered by a composite body patch.
Figure 13:
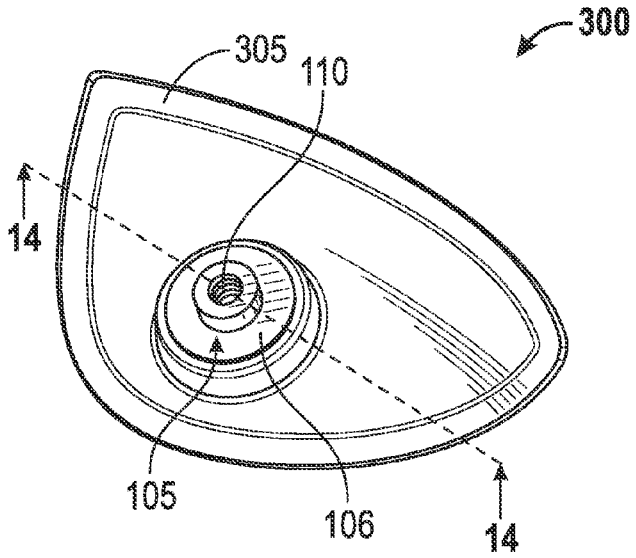
FIG. 13 is a rear perspective view of an embodiment of a composite body patch of the present invention.

As shown in FIGS. 9-12, the composite body patch 300, which preferably has an asymmetric, teardrop shape (but can be manufactured to have any desired shape), is sized to completely cover the cutout portion 77 of the aft body 70, thus preventing dirt and debris from entering the golf club head 40. The composite body patch 300 preferably is permanently affixed to the aft body 70 with an adhesive material. The cutout portion 77 preferably is circumscribed entirely by the material of the sole 64, as shown in FIGS. 9 and 10, but in an alternative embodiment it may be enclosed by the sole 64 on only one or two sides, as shown in FIGS. 11 *and* 12. In both of these structures, the crown (not shown) may be integrally cast with the rest of the club head, or it may be affixed to the club head 40 after the composite body patch 300 has been bonded to the sole 64. The crown used with this embodiment is preferably composed of a metal alloy material, but it may instead be a composite material formed using one or more of the techniques referenced above.

The composite body patch 300 shown in FIGS. 9-12 may be formed to have a consistent shape and size, such that it can be mass-produced for use in many different club heads. The composite body patch 300 is preferably formed with a ledge 305 to assist in alignment with the aft body 70 of the golf club head 40. The weight port 350 of the composite body patch 300 may have different features, as shown in FIGS. 13-20. In particular, the metal screw-receiving boss 105 may have different configurations and can be affixed to the weight receiving region 100 of the weight port 350 in different ways. The manner in which the metal screw-receiving boss 105 is affixed to the weight port 350 can affect both the durability of the weight port 350 and the retention of the weight 200 within the weight port 350. The features shown in FIGS. 13-20 may be applied to the weight ports 80, 82, 84 disclosed in connection with the preferred embodiment shown in FIGS. 1-5 in addition to the weight port 350 disclosed in connection with the composite body patch 300.

Figure 14:
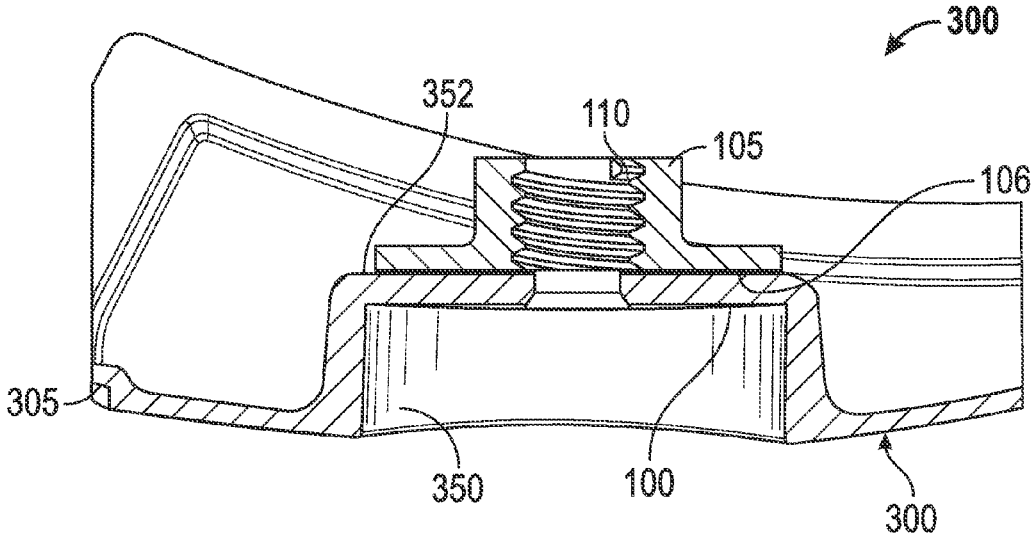
FIG. 14 is a cross-sectional view of the composite body patch shown in FIG. 13 along lines 14-14.
Figure 16:
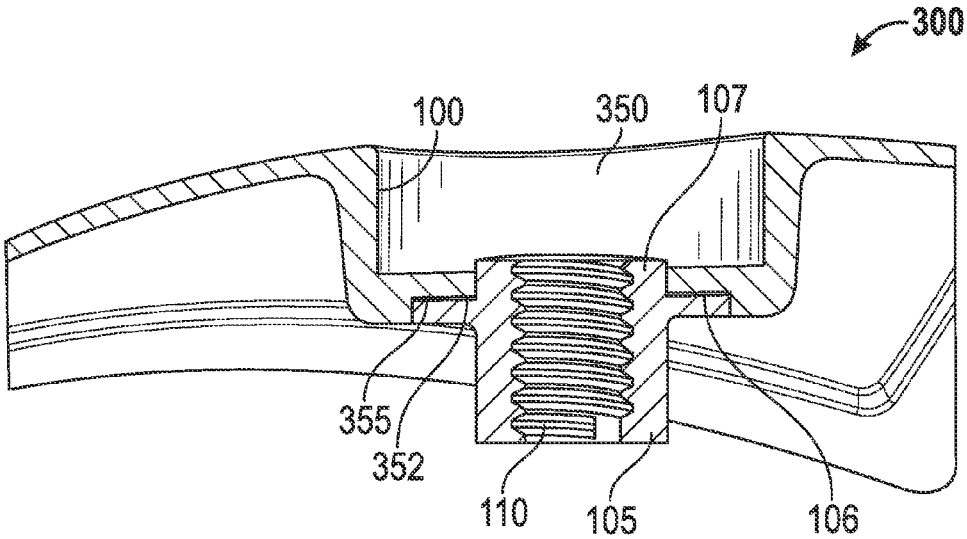
FIG. 16 is a cross-sectional view of the composite body patch shown in FIG. 15 along lines 16-16.
Figure 18:
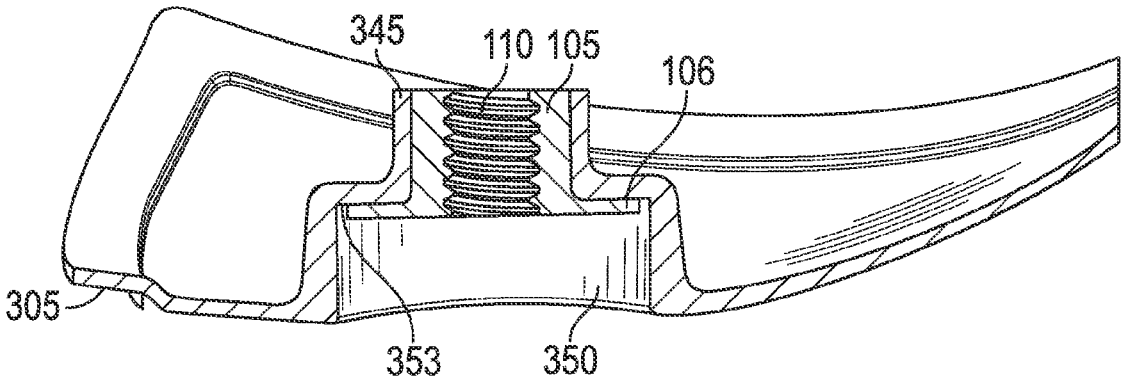
FIG. 18 is a cross-sectional view of the composite body patch shown in FIG. 17 along lines 18-18.

As shown in FIGS. 14, 16, and 18, the metal screw-receiving boss 105 preferably has an upper flange 106 and an internal bore 110 with threads sized to receive either a screw 210 or the integrally formed screw portion 220 of a weight screw. The metal screw-receiving boss 105 preferably is a single piece of metal that is either cast, forged, or machined to have the features described herein. In the embodiment shown in FIGS. 13 and 14, the upper flange 106 of the metal screw-receiving boss 105 is affixed to an interior surface 352 of the weight receiving region 100 of the integrally formed weight port 350. The flange 106 preferably rests against and is bonded to the interior surface 352 with a strong adhesive material. In this configuration, the weight 200, or the cylindrical head portion 230 of a weight screw, never directly touches the metal screw-receiving boss 105, as it is separated from the boss 105 by the composite material of the weight receiving region 100.

Figure 15:
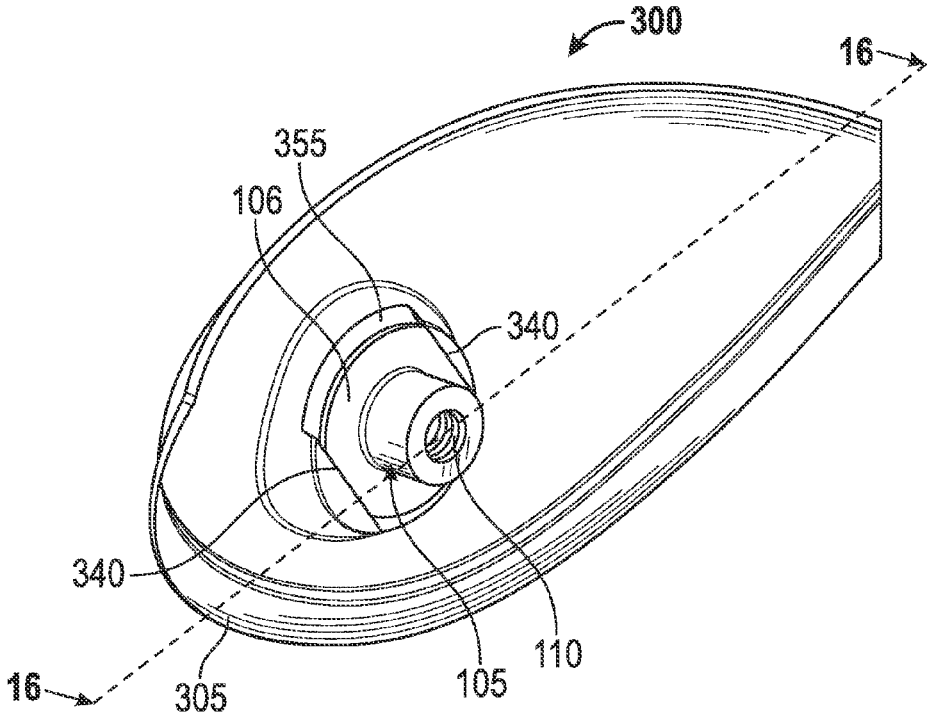
FIG. 15 is a rear perspective view of another embodiment of a composite body patch of the present invention.

In the embodiment shown in FIGS. 15 and 16, the metal screw-receiving boss 105 has a slight "T" shape such that an upper portion 107 extends partly into the weight receiving region 100 of the integrally formed weight port 350. This configuration provides a greater contact surface between the metal screw-receiving boss 105 and the weight port 350, and thus decreases the likelihood that the boss 105, and thus the weight 200, will detach from the weight port 350. The weight 200 will have minimal contact with the boss 105 at the upper portion 107, so a user may wish to insert a washer or o-ring into the weight port 350 to prevent unwanted friction. In this embodiment, the flange 106 rests against and is bonded to the interior surface 352 of the weight receiving region 100 of the weight port 350. As shown in FIG. 15, the interior surface 352 of the weight receiving region 100 has a depression 355 that is sized to receive the flange 106, and also has keyed sides 340 to prevent the metal screw-receiving boss 105 from twisting once it is placed and bonded within the depression 355.

Figure 17:
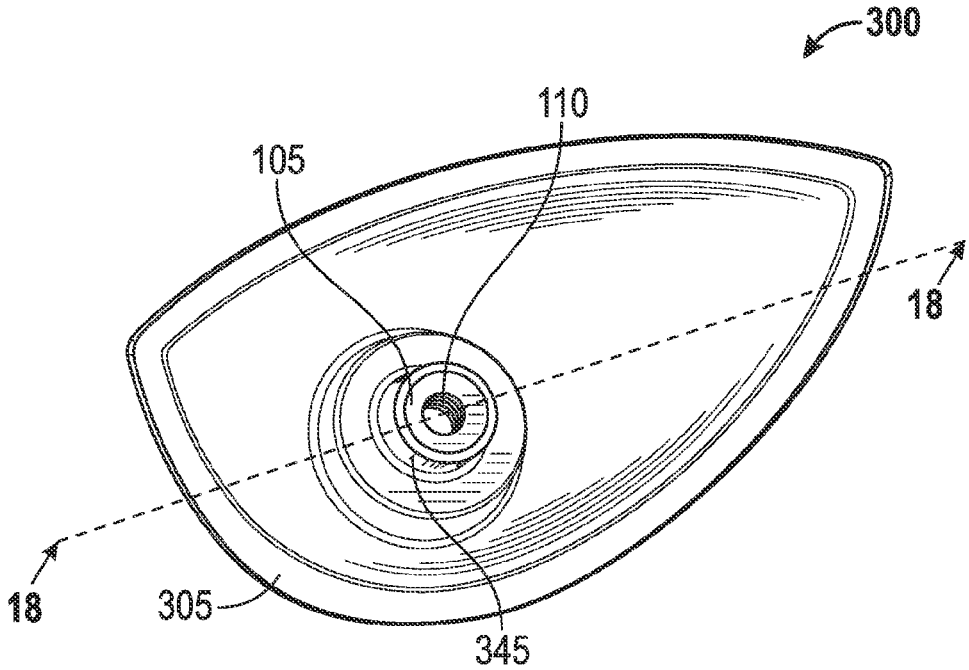
FIG. 17 is a rear perspective view of another embodiment of a composite body patch of the present invention.

The embodiment shown in FIGS. 17 and 18 is similar to the one shown in FIG. 7, as the flange 106 of the metal screw-receiving boss 105 rests against and is bonded to the exterior surface 353 of the weight receiving region 100. In this embodiment, however, the weight receiving region 100 of the weight port 350 has a tube portion 345 extending away from the weight port 350. The metal screw-receiving boss 105 is received within and bonded to the tube portion 345, thus providing significant contact and bonding surface to prevent the boss 105 from disengaging from the weight port 350. In this configuration, the weight 200 directly contacts the boss 105, so a user can place a washer between the boss 105 and the weight 200 to prevent unwanted friction.

Figure 19:
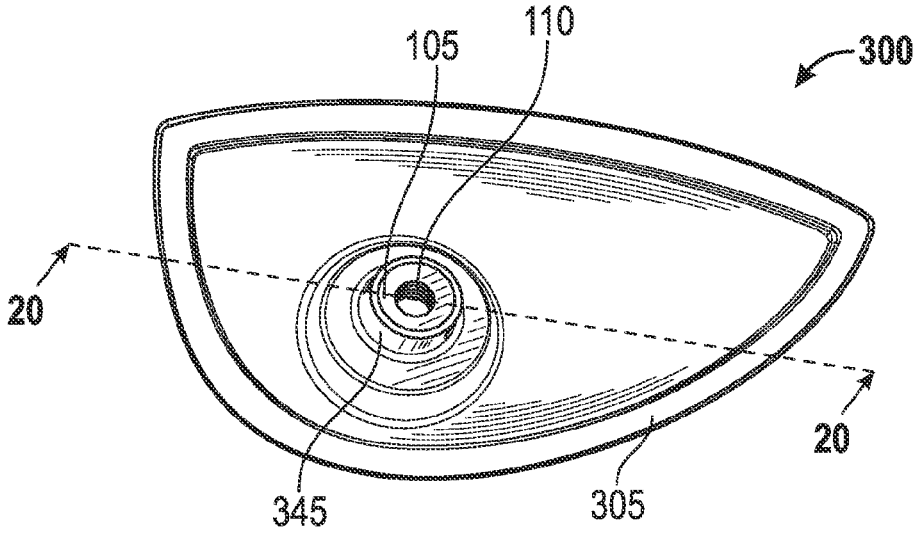
FIG. 19 is a rear perspective view of another embodiment of a composite body patch of the present invention.
Figure 20:
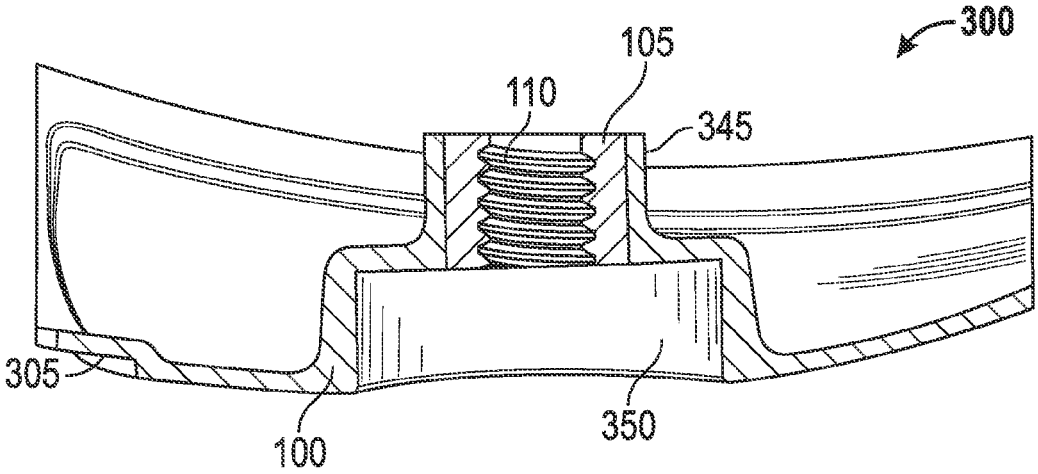
FIG. 20 is a cross-sectional view of the composite body patch shown in FIG. 19 along lines 20-20.

The embodiment shown in FIGS. 19 to 20 is similar to the embodiment shown in FIGS. 18 and 19, as the weight port 350 also includes the tube portion 345. The boss 105 in this embodiment, however, is much smaller than in the other embodiments because it lacks a flange 106, and is retained entirely within the tube portion 345. This configuration reduces the amount of material needed to form the boss 105, and thus reduces the overall weight of the weight port 350. Furthermore, since the weight 200 will have only minimal contact with the boss, a washer or o-ring is not needed to reduce friction.

Figure 24:
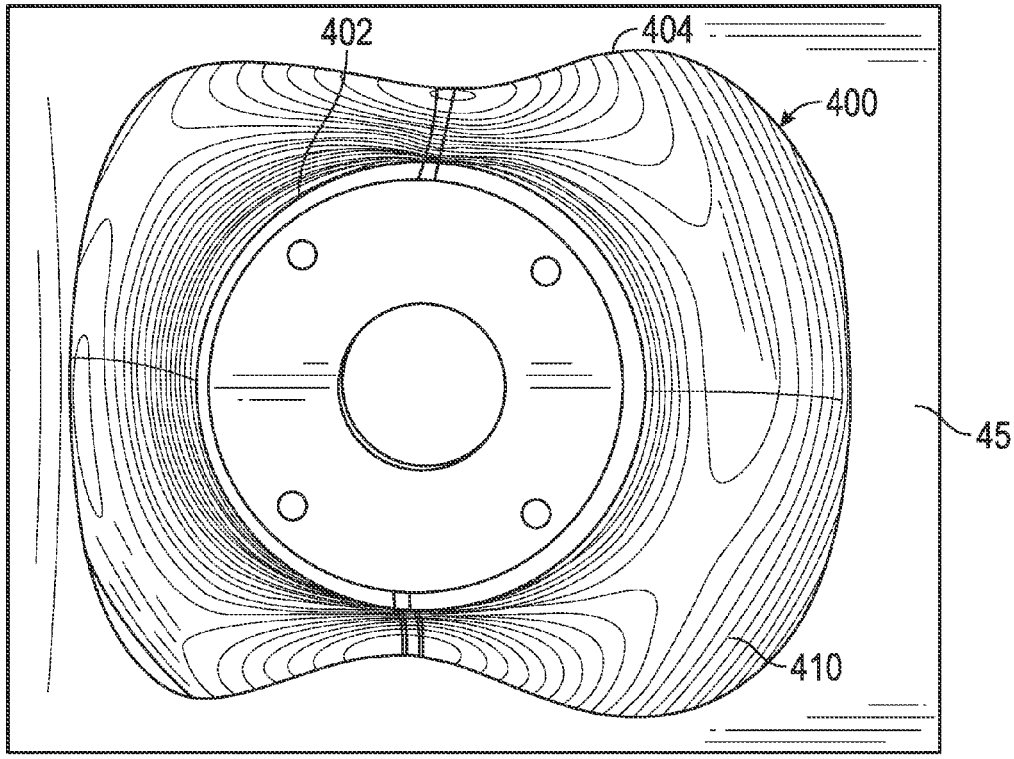
FIG. 24 is a rear perspective view of the weight port shown in FIG. 23 with lines indicating the weight port wall's variable radii.
Figure 25:
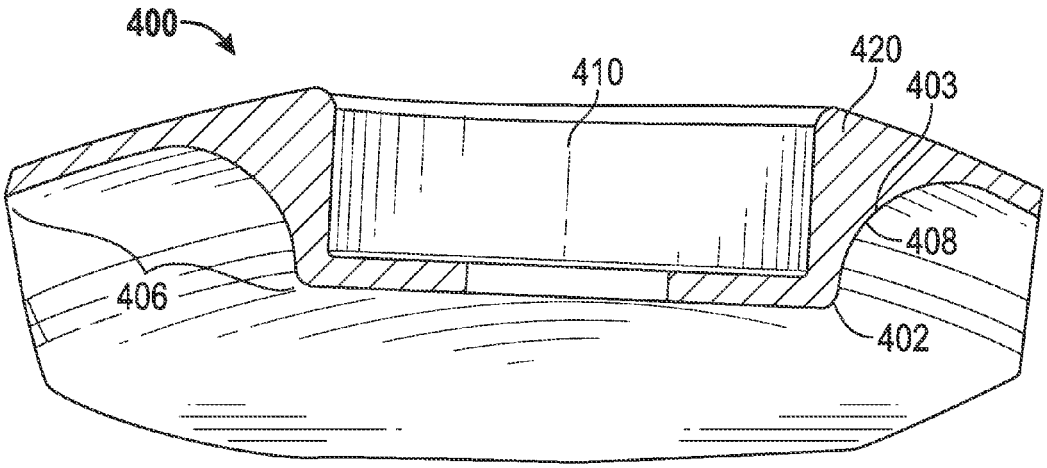
FIG. 25 is a cross-sectional view of the weight port shown in FIG. 23 along lines 25-25.
Figure 26:
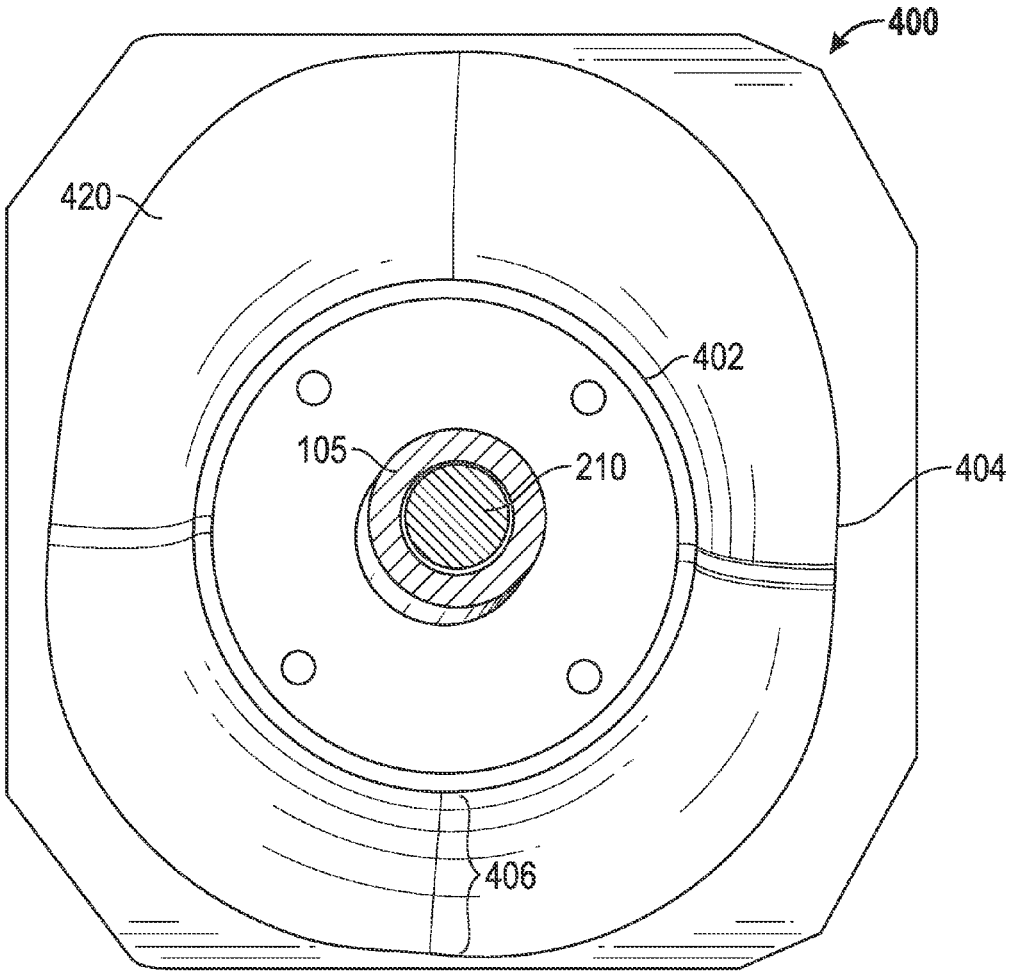
FIG. 26 is a rear perspective view of the weight port shown in FIG. 23 in combination with a metal boss and a weight screw.

The weight ports of each of the embodiments disclosed herein may, in an alternative embodiment, have the construction shown in FIGS. 23-26. In this embodiment, each weight port 400 comprises a weight port wall 420, a lowermost edge 402, and an uppermost edge 404, which comprises the points at which the weight port wall 420 is fully integrated into a wall 45 of the body portion of the golf club head 40. As shown in these FIGS, the weight port wall 420 is smoothly blended into the wall 45 of the golf club head 40, with a thickness that gradually changes from the lowermost edge 402 to the uppermost edge 404 over a variable thickness region 406, thus reducing the number of sharp edges in the weight port 400 and improving the strength and overall resilience of the weight port 400 when the golf club head 40 is in use. The variable thickness region 406 also preferably has a concave surface 408, which removes some mass from the construction of the weight port 400. As shown in FIG. 25, the variable thickness region 406 is thickest at an approximate midpoint 403 between the lowermost edge 402 and the uppermost edge 404.

As shown in FIG. 24, the weight port 400 preferably has a generally conical shape, with a radius that constantly changes across the weight port wall 420. The radiating lines 410 in FIG. 24 illustrate the varying radii of the weight port wall 420, which contribute to the improved strength of the weight port wall 420 and make supporting structures such as ribs, such as those disclosed in U.S. Pat. No. 7,419,441, unnecessary. This structure decreases the complexity of manufacturing the weight port 400 without sacrificing its structural integrity. When this weight port 400 construction is used in connection with the embodiment shown in FIGS. 1-3, the aft body 70 preferably is integrally formed from titanium, stainless steel, or another metal alloy, the face component 30 is integrally formed from titanium, stainless steel, or another metal alloy, and the face component 30 and aft body 70 are preferably welded together after they are formed.

Figure 27:
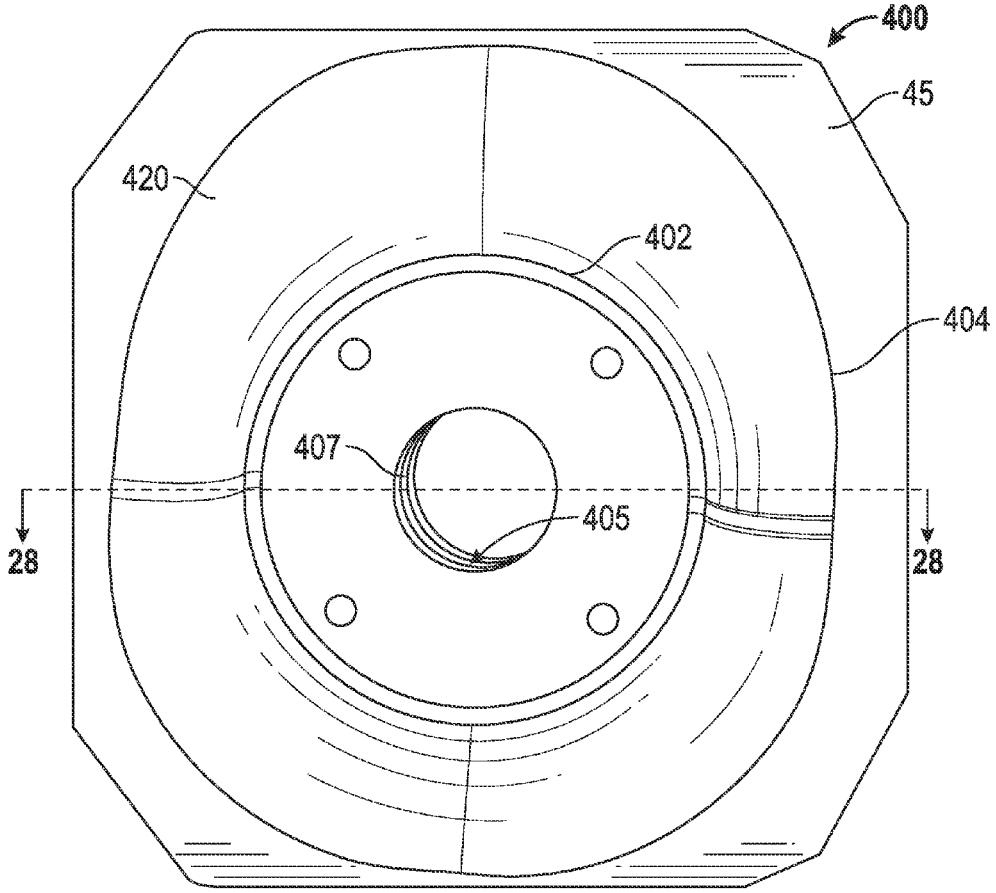
FIG. 27 is rear perspective view of a weight port according to another embodiment of the present invention.
Figure 28:
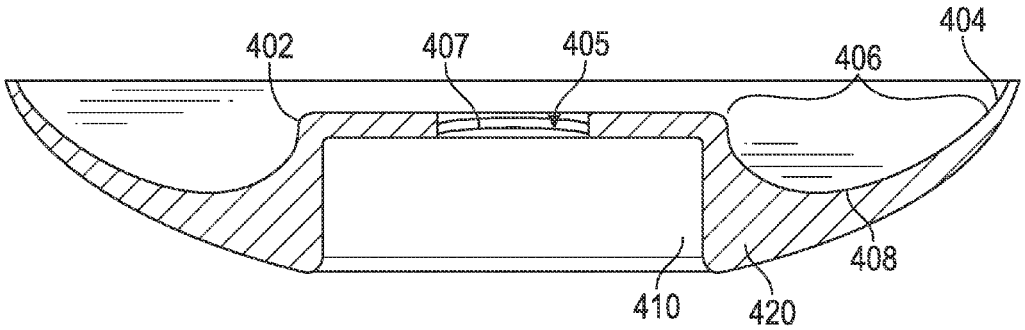
FIG. 28 is a cross-sectional view of the weight port shown in FIG. 27 along lines 28-28.

In yet another alternative embodiment, the weight ports of any of the embodiments disclosed herein, including the weight ports shown in FIGS. 23-26, may include the construction shown in FIGS. 27 and 28. In this embodiment, the screw-receiving region 405 is integrally formed in the weight port 400, and in contrast with the embodiment shown in FIG. 26, the golf club head 40 does not require a separate screw receiving boss 105 to allow the weight port 400 to receive a weight 200 or weight screw 210. The screw-receiving region 405 in this embodiment includes threads 407 that are integrally formed in the weight port 400 and receive the threaded portion of a weight screw 210 or a retaining bolt (not shown) used in connection with a standard weight 200. As with FIGS. 23-26, when this weight port 400 construction is used in connection with the embodiment shown in FIGS. 1-3, the aft body 70 preferably is integrally formed from titanium, stainless steel, or another metal alloy, the face component 30 is integrally formed from titanium, stainless steel, or another metal alloy, and the face component 30 and aft body 70 are preferably welded together after they are formed.

Figure 21A:
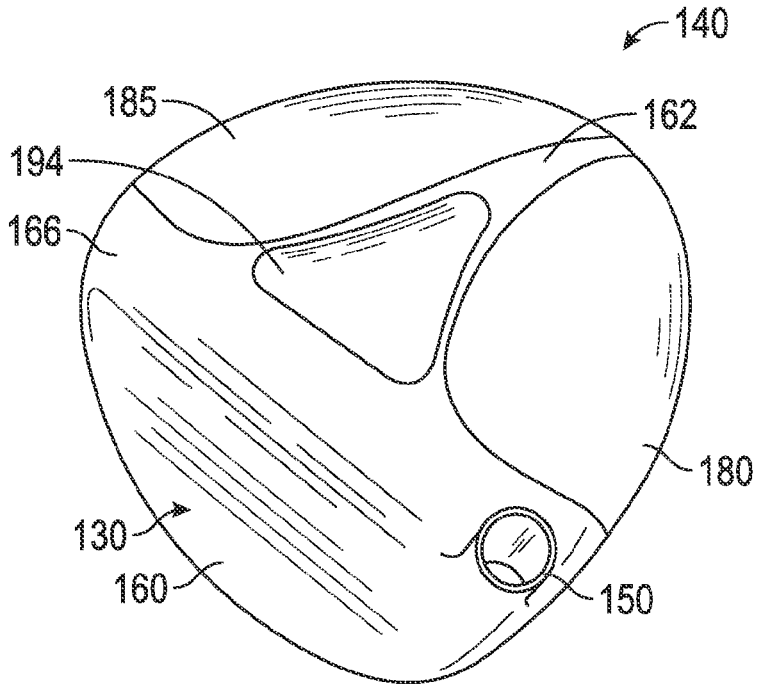
FIG. 21A is a top perspective view of a golf club according to a fourth embodiment of the present invention.
Figure 21B:
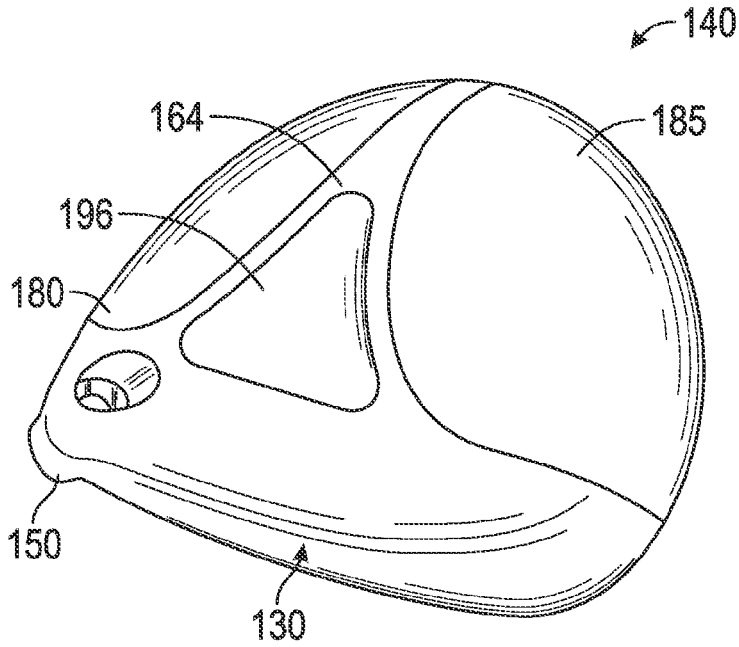
FIG. 21B is a bottom perspective view of the embodiment shown in FIG. 21A.
Figure 22:
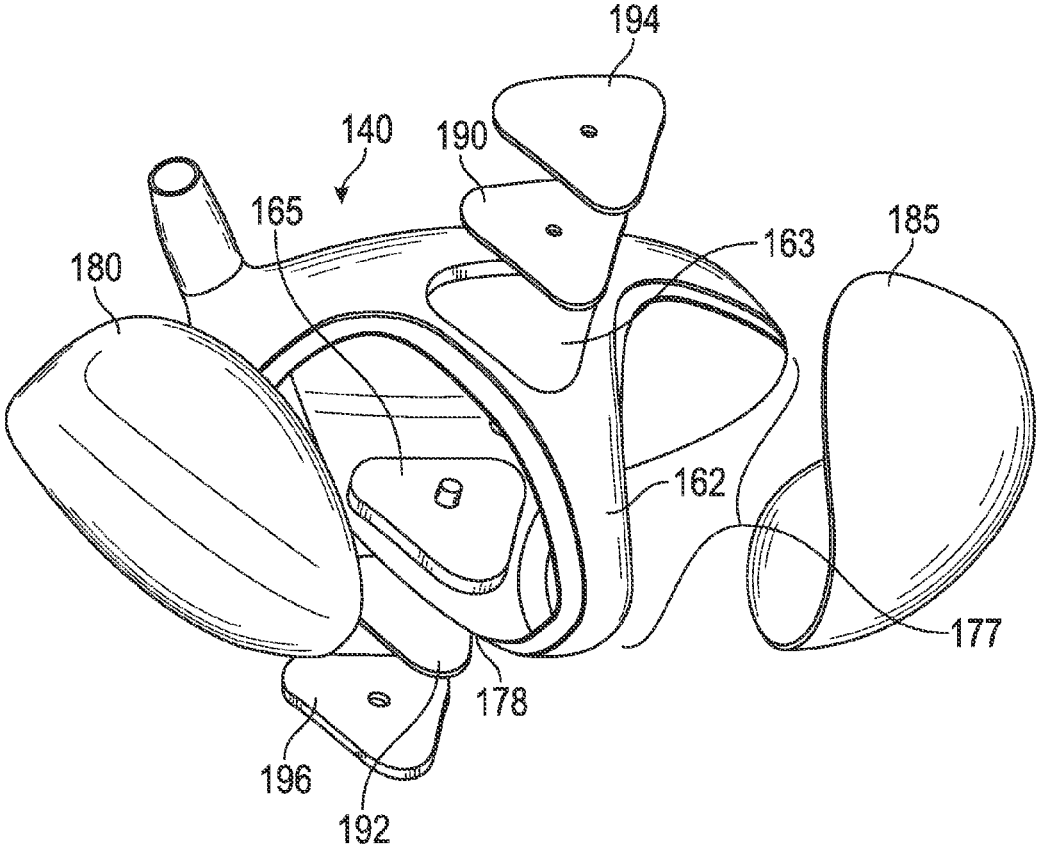
FIG. 22 is an exploded, top perspective view of the embodiment shown in FIG. 21A.
Figure 23:
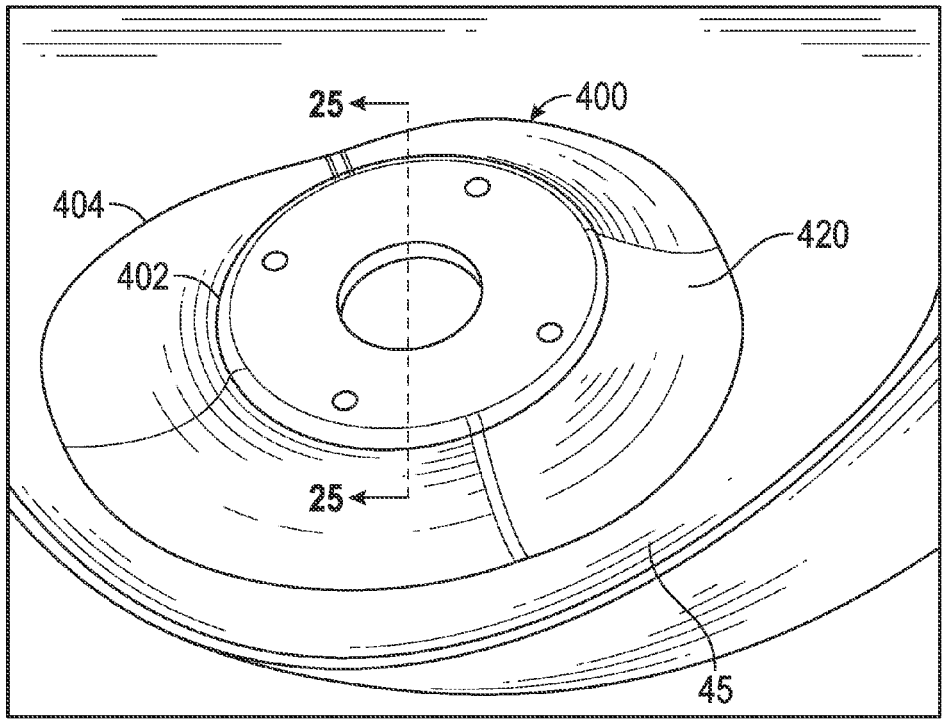
FIG. 23 is a rear perspective view of a weight port according to another embodiment of the present invention.

Another embodiment of the present invention is shown in FIGS. 21A, 21B, and 22. In this embodiment, the golf club head 140 comprises a body 145 with a face component 130 having a face 160 and a face extension 166, which is integrally formed with a hosel 150, a crown portion 162, and a sole portion 164. The golf club body 145 also comprises two large cutout portions 177, 178, one on its heel side 142, and one on its toe side 144. The body 145 preferably is integrally cast from a metal alloy, but may in alternative embodiments be pieced together from multiple components. Composite body patches 180, 185 are bonded to the body 145 to cover the cutout portions 177, 178. The composite body patches 180, 185 which are cup-shaped and form part of both the crown and the sole surfaces of the golf club head 140 when it is fully assembled, may further comprise weight ports having any of the structural features disclosed herein.

In the embodiment shown in these Figures, the body 145 comprises a first shallow recess 163 on the crown portion 162 and a second shallow recess 165 on the sole portion 164. Thin weights 190, 192 are disposed within these recesses 163, 165, secured with screws (not shown), and concealed with covers 194, 196 that preferably are formed from the same material as the body patches 180, 185. The weights 190, 192 may be removable to permit a golfer to adjust overall weighting of the golf club head 140, and may further be exchanged for other weights having different material compositions and densities. In an alternative embodiment, however, the weights 190, 192 are permanently retained within the recesses 163, 165, which can be achieved by bonding the covers 194, 196 to the golf club body 145.

In other embodiments, the face component 30 and crown 62 may be made from cast or forged metals or from composite materials, and may be formed integrally or pieced together. In yet other embodiments, the face component 30 and crown 62 each may be composed of different materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

Another aspect of the golf club head 40 of the present invention is directed a golf club head 40 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 40 preferably has a coefficient of restitution ranging from 0.80 to 0.94, as measured under conventional test conditions.

The coefficient of restitution of the club head 40 of the present invention under standard USGA test conditions with a given ball preferably ranges from approximately 0.80 to 0.94, more preferably ranges from 0.82 to 0.89 and is most preferably 0.86.

As defined in *Golf Club Design, Fitting, Alteration & Repair,* $4^{th}$ Edition, by Ralph Maltby, the center of gravity, or center of mass, of the golf club head 40 is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 40 are preferably measured using a test frame ($X^T$, $Y^T$, $Z^T$), and then transformed to a head frame ($X^H$, $Y^H$, $Z^H$). The center of gravity of a golf club head 40 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head 40, the scales allow one to determine the weight distribution of the golf club head when the golf club head 40 is placed on both scales simultaneously and weighed along a particular direction, the X, Y or Z direction.

In general, the moment of inertia, Izz, about the Z axis for the golf club head 40 of the present invention is preferably greater than 3000 g-cm$^2$, and more preferably greater than 3500 g-cm$^2$. The moment of inertia, Iyy, about the Y axis for the golf club head 40 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 40 of the present invention is preferably in the range from 1500 g-cm$^2$ to 3800 g-cm$^2$, more preferably from 1600 g-cm$^2$ to 3100 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a metal face component comprising a striking surface and a face extension; and a metal aft body comprising a crown, a sole, and at least one weight port, wherein the at least one weight port comprises an upper edge, a lower edge, and a wall extending around the entire circumference of the weight port, wherein the wall does not comprise any ribs, wherein the wall comprises a thickness that changes gradually from the upper edge to the lower edge and is thickest at a point located between the upper edge and the lower edge, wherein the wall comprises multiple radii, wherein the wall comprises a generally conical shape, wherein a thickest point of the wall is located approximately midway between the upper edge and the lower edge, and wherein the at least one weight port is integrally formed with the sole.

2. The golf club head of claim 1, wherein the wall further comprises a concave surface.

3. The golf club head of claim 1, wherein the golf club head further comprises at least one removable weight sized to fit within and make direct contact with the at least one weight port.

4. The golf club head of claim 1, wherein the sole comprises a heel section and a toe section, and wherein the at least one weight port is disposed in the toe section.

5. The golf club head of claim 4, wherein the sole further comprises a second weight port, and wherein the second weight port is located in the heel section.

6. The golf club head of claim 1, wherein the weight port further comprises a weight receiving region having a first diameter and a first bore having a second diameter, and wherein the first diameter is greater than the second diameter.

7. The golf club head of claim 6, wherein the first bore comprises threads.

8. A golf club head comprising:

a metal face component comprising a striking surface and a face extension;

a metal aft body comprising a crown, a sole, and at least one weight port comprising an upper edge, a lower edge, a wall extending around the entire circumference of the weight port, and a weight receiving region having a first diameter and a first bore having a second diameter, and a screw-receiving component comprising a second bore, wherein the screw-receiving component is affixed to the weight port such that the first bore aligns with the second bore, and wherein the first diameter is greater than the second diameter.

9. The golf club head of claim 8, wherein the screw-receiving component is composed of a metal material.

10. A driver-type golf club head comprising:

a metal face component comprising a striking surface and a face extension;

a crown;

a sole; and at least one removable weight, wherein the sole comprises at least one weight port comprising an upper edge, a lower edge, a wall extending around the entire circumference of the weight port, a weight receiving region having a first diameter, and a first bore having a second diameter, wherein the first diameter is greater than the second diameter, wherein the first bore comprises threads, wherein the wall does not comprise any ribs, wherein the wall comprises multiple radii, a concave surface, and a thickness that changes gradually from the upper edge to the lower edge and is thickest at a point located approximately midway between the upper edge and the lower edge, wherein the at least one removable weight is sized to fit within and make direct contact with the at least one weight port, wherein the at least one weight port is integrally formed with the sole, and wherein the golf club head has a volume of at least 400 and no more than 500 cubic centimeters.

11. The golf club head of claim 10, wherein the sole comprises at least two weight ports.

12. The golf club head of claim 10, wherein the crown is composed of a composite material.

13. A driver-type golf club head comprising:

a metal face component comprising a striking surface and a face extension;

a crown;

a sole; and at least one removable weight, wherein the sole comprises at least one weight port comprising an upper edge, a lower edge, a wall extending around the entire circumference of the weight port, a weight receiving region having a first diameter, and a first bore having a second diameter, wherein the first diameter is greater than the second diameter, wherein the first bore comprises threads, wherein at least one weight port is located in each of the crown and the sole, wherein the at least one removable weight is sized to fit within and make direct contact with the at least one weight port, wherein the at least one weight port is integrally formed with the sole, and wherein the golf club head has a volume of at least 400 and no more than 500 cubic centimeters.

14. A wood-type golf club head comprising:

a face component comprising a striking surface and a return portion, the face component composed of a metal alloy;

a metal sole comprising at least one weight port, the at least one weight port integrally formed with the sole; and at least one removable weight screw comprising a head portion and a threaded extension portion, wherein the at least one weight port comprises an upper edge, a lower edge, a wall, a weight receiving region having a first diameter, and a bore having a second diameter, wherein the first diameter is greater than the second diameter, wherein the wall does not comprise any ribs, wherein the wall comprises multiple radii and a thickness that changes gradually from the upper edge to the lower edge and is thickest at a point located approximately midway between the upper edge and the lower edge, wherein the head portion is sized to fit within the weight receiving region, and wherein the bore comprises threads sized to mate with the threaded extension portion.

15. The wood-type golf club head of claim 14, wherein the golf club head has a volume of no less than 120 cubic centimeters and no more than 500 cubic centimeters.

16. The wood-type golf club head of claim 14, wherein the wall comprises a concave surface.

* * * * *